United States Patent [19]

Dechelette

[11] Patent Number: 4,657,329

[45] Date of Patent: Apr. 14, 1987

[54] BOARD MOUNTED CABLE CONNECTOR

[75] Inventor: Helen Dechelette, Paris, France

[73] Assignee: Molex Incorporated, Lisle, Ill.

[21] Appl. No.: 822,555

[22] Filed: Jan. 27, 1986

[30] Foreign Application Priority Data

Mar. 5, 1985 [GB] United Kingdom ..... 8505576

[51] Int. Cl.[4] ..... H01R 4/24

[52] U.S. Cl. ..... 339/97 P

[58] Field of Search ..... 339/97 R, 97 P, 98, 339/99 R

[56] References Cited

U.S. PATENT DOCUMENTS 4,466,687 8/1984 Frantz ..... 339/99 R 4,494,813 1/1985 Daley, Jr. et al. ..... 339/99 R 4,560,226 12/1985 Dennis ..... 339/99 R

*Primary Examiner*—Joseph H. McGlynn

*Attorney, Agent, or Firm*—Louis A. Hecht; John W. Cornell

[57] ABSTRACT

Disclosed is a board mounted electrical connector for terminating the free end of a flat round conductor cable to post terminals mounted on the board. The connector includes a housing having a cable receiving end and opposed mating end, with a bottom wall having a board engaging surface extending therebetween. Extending parallel to the board engaging surface, between the conductor receiving and mating end is a plurality of wire and terminal receiving cavities which have an open top, communicating with a top surface of the connector housing. Terminals received in the cavities have a wire engaging portion with insulation piercing barbs, and an opposed pin engaging portion with an integrally formed cantilever spring finger. When loaded into the housing, the wire engaging portion of the terminal terminates wire conductors received at one end of the cavity while the pin engaging portion is positioned adjacent pin receiving passageways located adjacent the mating end of the housing. As the connector is lowered onto an upper surface of the printed circuit board, post-like terminals mounted on the board are received in the pin receiving passageways to make sliding contact with the cantilevered spring fingers.

10 Claims, 3 Drawing Figures

BOARD MOUNTED CABLE CONNECTOR

BACKGROUND OF THE INVENTION

1. Field of the Invention

This invention pertains to low profile connectors for use with printed circuit boards, and particularly to connector arrangements for electrically interconnecting a flat round conductor cable to post terminals mounted adjacent a free edge of a printed circuit board.

2. Brief Description of the Prior Art

One connection system commonly used in the telephone industry today employs arrays of post terminals for interconnecting large numbers of circuits contained on panel or printed circuit boards. It is frequently necessary to connect the board mounted post terminals to the conductors of cable assemblies which originate at locations remote from the circuit board.

One example of a connector in use today, described in European Patent Application No. 0,057,780 filed Feb. 11, 1981, includes a single row of pin receiving terminals arranged side by side in a common connector housing. The connector is inserted end-wise over the post terminals, presenting a relatively high profile in that the connector body and cable conductors extend at right angles to the printed circuit board surface. Efforts in reducing the overall size of pin receiving connectors has resulted in the miniature connector which is shown and described in U.S. patent application Ser. No. 555,784 filed Nov. 28, 1983 and assigned to the assignee of the present invention. An insulation displacing wire engaging portion and a pin engaging portion are integrally formed in the terminal, immediately adjacent each other. However, while providing a connector of overall reduced size, the arrangement still presents a relatively high profile since the axis of the cable conductors extends parallel to that of the terminal posts, i.e., perpendicular to the surface of the printed circuit board.

A somewhat lower profile arrangement is shown in Great Britain Patent Application No. 1,558,582 filed Nov. 25, 1976 has a similar arrangement of pin receiving terminals, but the cable conductors extend at a right angle to those terminals, parallel to the printed circuit board surface. Even though this affords a somewhat closer spacing between adjacent, stacked printed circuit boards, even closer spacings are required today.

The arrangements described above are for discrete round wire conductors, rather than the multi-conductor flat cable currently in use today in telephone interconnections. One popular modular telephone connector in use today with such cable is described in U.S. Pat. No. 3,998,514, assigned to the Western Electric Company. The connector has a housing which slidingly receives a series of integral terminals having insulation piercing wire engaging portions. A flat multi-conductor cable is inserted in one end of the connector housing, with the individual circuit conductors being received in passageways formed in the housing. The cable conductors are terminated as the insulation piercing portions of the terminals are inserted into the passageways, during loading of the terminals in the housing. It would be desireable to use the same termination techniques at each end of a harness having one of these telephone connectors.

The spacing between conductors of this cable frequently is somewhat closer than the spacing that can be permitted between board-mounted, post adjacent terminals. Therefore, a transition connector, (one providing a transition between the two interelement spacings involved) is required.

It is therefore an object of the present invention to provide a low profile pin receiving connector which is adapted to electrically interconnect a multi-conductor flat cable to post terminals mounted on a printed circuit board.

Another object of the present invention is to provide a low profile transition connector for interconnecting a flat cable having one interconductor spacing, to an array of post terminals having a different interelement spacing.

Yet another object of the present invention is to provide a cable-to-board pin receiving connector having terminals with insulation piercing conductor engaging portions which make electrical contact with the wire conductors as the terminals are loaded in the connector housing.

Still another object of the present invention is to provide a high density, low profile cable-to-board connector having integral stamped terminals formed from a flat sheet oriented generally perpendicular to the printed circuit board, and which are formed to preserve their flat, plate-like configuration.

SUMMARY OF THE INVENTION

These and other objects of the present invention are provided in a low profile electrical connector for connecting a plurality of printed circuit board mounted pins with the end portion of a flat multi-conductor cable, said connector including, a dielectric housing having a board engaging surface, an opposed top surface and a conductor receiving end, said housing further having a plurality of terminal receiving cavities extending between a pin receiving opening in said board engaging surface and said conductor receiving end, and a plurality of metallic stamped terminals mounted in said cavities, each terminal having a conductor engaging portion adjacent the conductor receiving end and a resilient female pin engaging portion adjacent the board engaging surface the improvement comprising: said conductor engaging portion of each terminal being positioned laterally adjacent said pin engaging portion and immediately adjacent said board engaging surface, and being adapted to engage a conductor extending generally parallel to said board engaging surface.

BRIEF DESCRIPTION OF THE DRAWINGS

In the drawings, wherein like elements are referenced alike.

DETAILED DESCRIPTION OF THE PREFERRED EMBODIMENT

Figure 1:
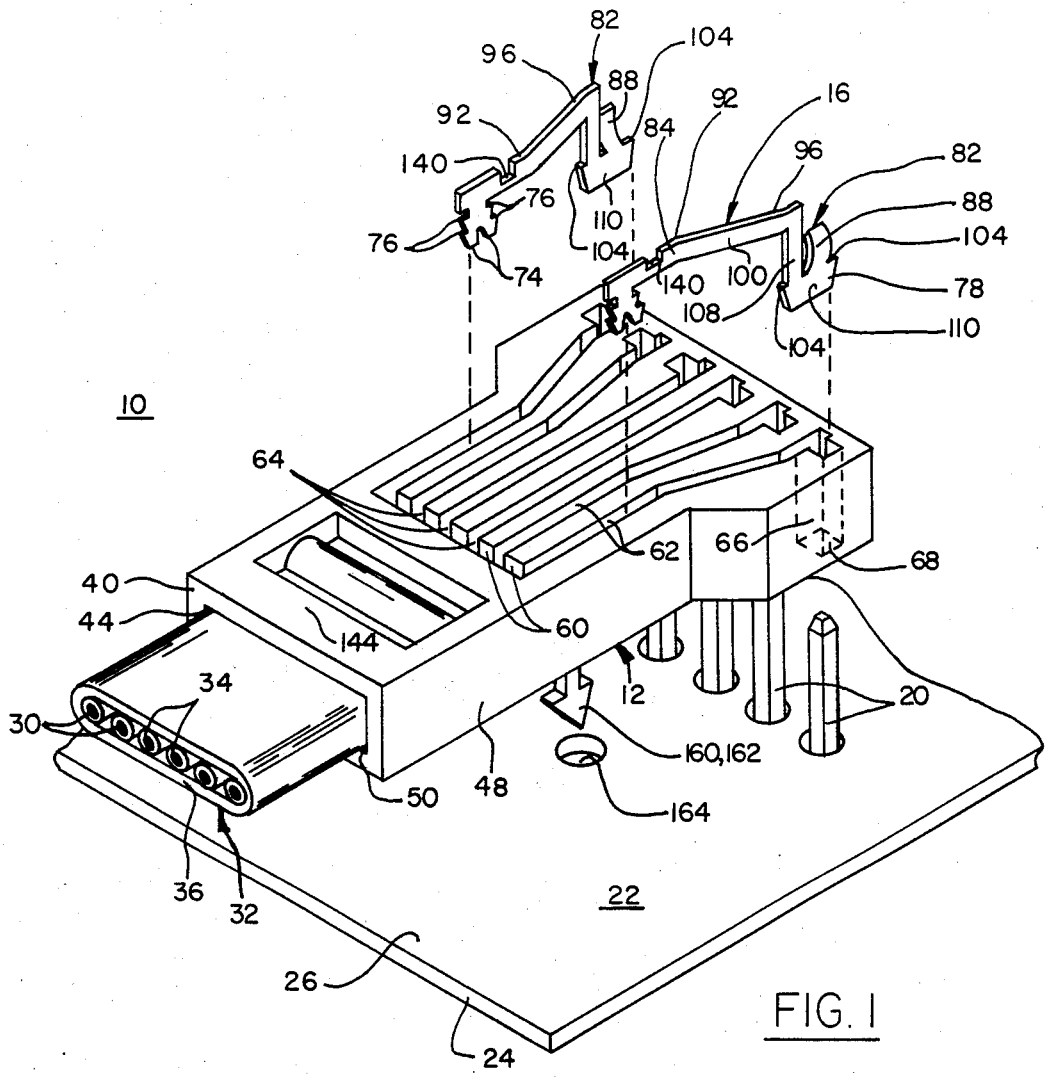
FIG. 1 is an exploded perspective view of the connector according to the present invention.

Referring now to the drawings, and especially to FIG. 1, a connector according to the present invention, generally indicated at 10, comprises a connector housing 12 and a plurality of pin-receiving terminals 16. Connector 10 is adapted to mate with a plurality of pins or post terminals 20 which are mounted in printed circuit board 22 adjacent a free edge 24. When lowered onto an upper mounting surface 26 of printed circuit board 22, connector 10 slidingly engages post terminals 20. Connector 10 is adapted to terminate the wire conductors 30 of a flat cable 32, to post terminals 20. Cable 32 is of conventional design, with a plurality of wire conductors 30, each having an insulative covering 34 of dielectric material, enclosed within a dielectric sheath 36.

Figure 2:
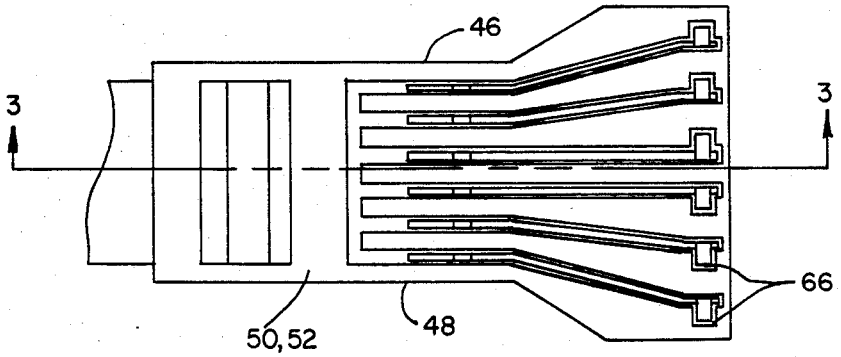
FIG. 2 is a plan view of the connector of FIG. 1 taken from the bottom, pin-receiving end.
Figure 3:
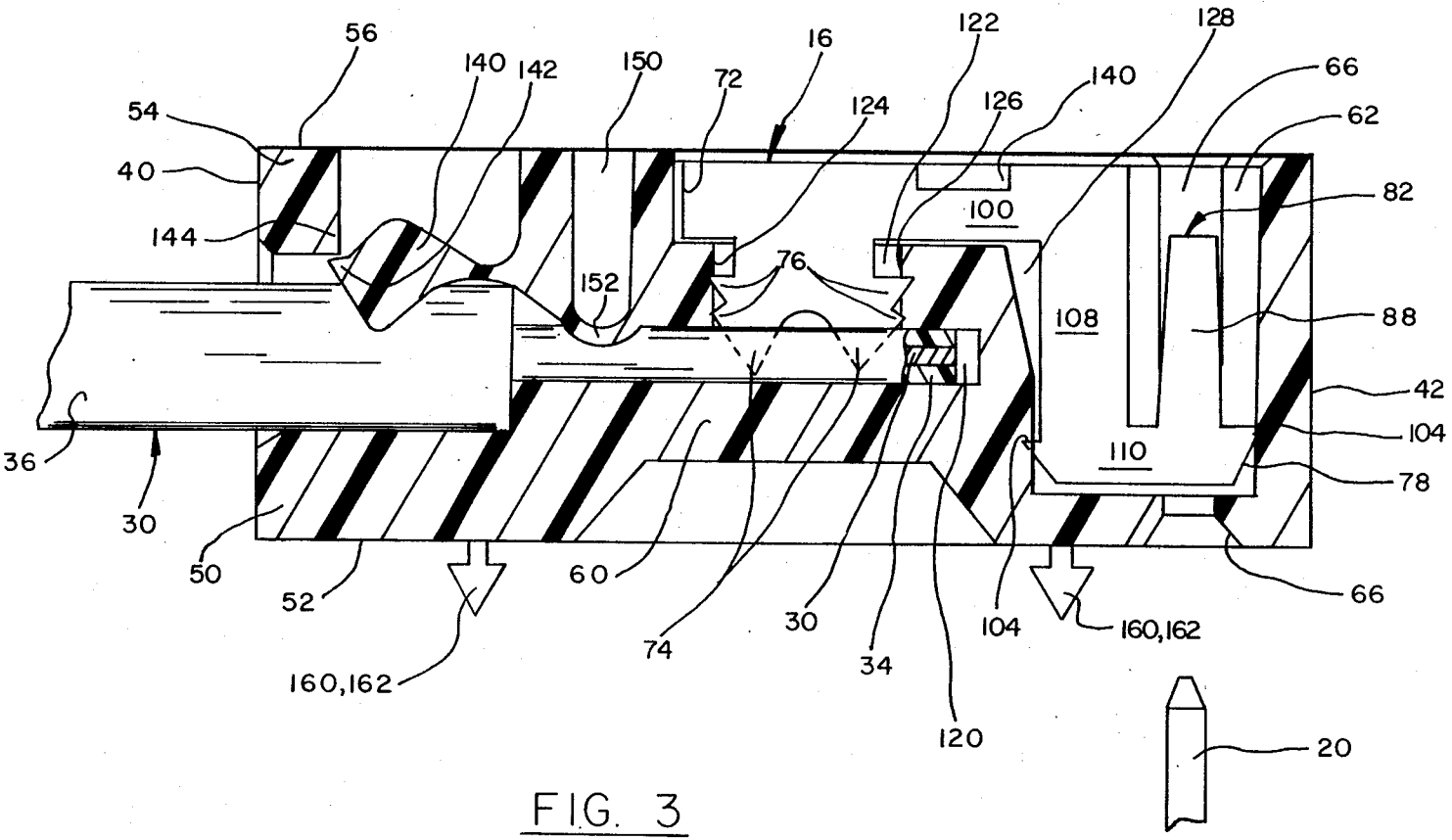
FIG. 3 is a cross sectional view taken along the lines of 3—3 of FIG. 2.

Referring to FIGS. 1–3, connector 10 includes a housing 12 having a conductor receiving end 40 and an opposed mating end 42. Conductor receiving end 40 includes a cable receiving opening 44, and strain relief means for retaining the cable in the housing. Housing 12 also include sidewalls 46, 48, a bottom wall 50 having an exterior board engaging surface 52, and a top wall 54 having a top surface 56. The interior portion of housing 12 adjacent the conductor receiving end 40 is hollow, whereas the portion adjacent mating end 42 has a plurality of internal barriers 60 forming a plurality of elongated wire and terminal receiving cavities 62 which communicate with top surface 56. The laterally outermost barriers 60 cooperate with housing sidewalls 46, 48 to form the laterally endmost wire and terminal receiving cavities. Cavities 62 include conductor receiving openings 64 which are preferrably scalloped or funnel-shaped to promote insertion of wire conductors 30 therethrough. The opposed end of cavities 62, located adjacent mating end 42, and terminated in pin terminal receiving passageways 66 which, at one end, communicate with board engaging surface 52, forming a pin receiving opening 68 therein. The upper ends of pin receiving openings 66 communicate with top surface 56 to facilitate loading of terminals 16 in housing 12.

The end of flat cable 32 inserted in housing 12 is stripped, and individual conductors 30 are fanned out, each conductor being received in its respective cavity 62. After insertion of cable 32, terminals 16 are lowered into housing 12, to terminate wire conductors 30 and to effect loading of the terminals, as will be described.

Terminals 16 have a wire engaging end 72 with insulation piercing barbs 74 and terminal retention teeth 76 formed therein. The opposed pin receiving end 78 of terminal 16 has a cantilevered pin engaging finger 82 struck out therefrom. Cantilever finger 82 is formed to have a spring-like bowed contact portion 88 which slidingly engages an external surface of post terminal 20. Terminals 16 are preferably formed from an integral stamped blank to have a generally flat, plate-like configuration, and are arranged to lie in a plane generally perpendicular to mounting surface 26 of printed circuit board 22 to minimize the area of board engaging surface 52.

Although the pin receiving end 78 of terminal 16 is of a generally U-shaped configuration formed from a downwardly extending leg 108 depending from intermediate portion 100, finger 82, and an intermediate bight portion 110, other arrangements will become apparent to those skilled in the art. For example, bight portion 110 could be located near the top surface of the connector housing. Also, if deeper penetration into the board mounting surface 26 can be tolerated, fingers 82 can extend in a direction generally parallel to the board mounting surface, rather than being disposed generally perpendicular thereto, as indicated in the preferred embodiment. Contact surface 88, which engages the post terminals 20, could also comprise a dimple portion formed in a flat plate-like end of terminal 16. While other contact arrangements can be employed, terminal 16 of the preferred embodiment is of generally flat plate-like configuration which avoids laterally extending rolled over or folded portions. The board engaging surface 52 of this arrangement presents a minimum surface area or "real estate" requirement for mounting on printed circuit board 22. In any event, the wire engaging portion of the terminal will be positioned laterally adjacent the pin engaging portion and immediately adjacent the board engaging surface while the cable conductors extend generally parallel to the board engaging surface of the housing.

Typically, in the telephone industry, the spacing between the individual wire conductors 30 of flat cable 32 is substantially smaller than the spacing between post terminals 20, which are colinearly aligned adjacent the free edge 24 of printed circuit board 22. To accommodate this difference in spacing, connector 10 provides a transition in spacing with the mating end being enlarged so as to accommodate a fan-out of terminals 16. Plate-like terminals 16 are bent with a first lateral offset 92 to form the fan-out required for the spacing transition. To conform with the surfaces of post terminals 20, which have a square cross-section, terminals 16 are provided with a second lateral offset 96 adjacent the mating end of the connector. Lateral offsets 92,96 are preferrably formed in intermediate terminal portion 100 which extends generally parallel to the board engaging surface 52.

Referring now to FIG. 3, cavities 62 conveniently comprise a longitudinally extending conductor receiving passageway 120 which is closed at its forward end. Communicating with conductor receiving passageway 120 is a downwardly extending channel 122 which receives the insulation piercing portion of terminal conductor engaging end 72. Passageway 122 forms sidewalls 124,126 which are penetrated by teeth 76 to provide terminal retention therein. The lowermost barbs 74 penetrate the dielectric covering 34 surrounding each conductor 30 to terminate the conductor. A downwardly extending pocket 128 formed at the mating end of cavity 62 receives the leg 108, bight portion 110 and finger 82 of terminal 16. Pin receiving passageway 66 is formed to one side of pocket 128.

A hinged tab 140, formed adjacent the cable receiving end 40 of housing 12, has a free end which is deflect into the cable receiving passageway 44 to engage cable sheath 36. The upper free end 142 of tab 140 engages transverse housing wall portion 144 to maintain strain relief engagement with cable 32. Formed adjacent strain relief 110 is a downwardly extending channel 150 which comprises a blind hole having a relatively thin end wall 152 which is driven into the dielectric covering 34 of an individual conductor 30 to provide additional strain relief therefor.

Although illustrated in the various figures as having an open top surface, housing 12 can be enclosed with an upper wall member once terminals 16 are loaded therein and termination to cable 32 is effected. The upper wall could have downwardly extending protrusions received within notches 140 formed in terminals 16 to further limit longitudinal movement of terminals. If additional vertical securement of connector 10 to printed circuit board 22 is required, integrally molded engaging pins 160 having enlarged heads 162 can be provided, for insertion in appropriate mounting holes 164 formed in printed circuit board 22.

What is claimed is:

1. A low profile electrical connector for connecting a plurality of printed circuit board mounted pins with the end portion of a flat multi-conductor cable, said connector including, a dielectric housing having a board engaging surface, an opposed top surface and a conductor receiving end, said housing further having a plurality of terminal receiving cavities extending between a pin receiving opening in said board engaging surface and said conductor receiving end, and a plurality of metallic stamped terminals mounted in said cavities, each terminal having a conductor engaging portion adjacent the conductor receiving end and a resilient female pin engaging portion adjacent the board engaging surface the improvement comprising: said conductor engaging portion of said terminal being positioned laterally adjacent said pin engaging portion and immediately adjacent said board engaging surface, and being adapted to engage a conductor extending generally parallel to said board engaging surface.

2. The connector of claim 1 wherein each of said terminals comprise an elongated plate-like member lying in a plane extending generally perpendicular to said board engaging surfaces.

3. The connector of claim 2 wherein said terminal receiving cavities comprise elongated passageways extending generally parallel to said board engaging surface, said channels having an open top communicating said top surface of said dielectric housing for receiving said terminals.

4. The connector of claim 3 further comprising strain relief means formed in said dielectric housing adjacent said conductor receiving end for engaging said cable.

5. The arrangement of claim 3 further comprising printed circuit board engaging means integrally formed with said housing so as to provide fixed securement between said housing and said printed circuit board when said pin engaging portions are mated with said board-mounted pins.

6. The connector of claim 3 wherein said resilient female pin engaging portion comprises a cantilever spring finger struck out from said plate-like member.

7. The connector of claim 6 wherein said cantilever spring finger is located adjacent one end of said plate-like member and said conductor engaging portion comprises an insulation piercing member formed adjacent an opposing end of said plate-like member.

8. The connector of claim 6 further comprising housing engaging means laterally formed with said plate-like member adjacent said cantilever spring finger for engaging said dielectric housing so as to retain said pin engaging portion therein during enggement with said pin.

9. The connector of claim 2 wherein said plurality of printed circuit board mounted pins are spaced apart from each other a first predetermined distance, said conductors of said cable are spaced apart from each other a second predetermined distance, and said elongated plate-like terminal members include lateral offsets so as to provide a transition between the spacing of said board mounted pins and said cable conductors.

10. The arrangement of claim 9 wherein said board-mounted pins have a generally square cross-section and said plate-like terminal members include a second of lateral offset to align said pin engaging portion with an exterior surface of said board-mounted pins.

* * * * *